US010533345B2

(12) United States Patent
Green

(10) Patent No.: US 10,533,345 B2
(45) Date of Patent: Jan. 14, 2020

(54) ELECTRONIC LOCKING DEVICE

(71) Applicant: Henry Squire & Sons Holdings Ltd, Wolverhampton (GB)

(72) Inventor: Glyn Green, Cannock (GB)

(73) Assignee: HENRY SQUIRE & SONS HOLDINGS LTD (GB)

( * ) Notice: Subject to any disclaimer, the term of this patent is extended or adjusted under 35 U.S.C. 154(b) by 60 days.

(21) Appl. No.: 15/979,847

(22) Filed: May 15, 2018

(65) Prior Publication Data

US 2018/0328081 A1 Nov. 15, 2018

(30) Foreign Application Priority Data

May 3, 2017 (GB) ..... 1706982.4

(51) Int. Cl.
*E05B 17/00* (2006.01)
*E05B 47/00* (2006.01)
*E05B 47/06* (2006.01)

(52) U.S. Cl.
CPC ..... *E05B 47/0619* (2013.01); *E05B 17/0054* (2013.01); *E05B 47/0002* (2013.01); *E05B 47/0603* (2013.01); *E05B 2047/0063* (2013.01)

(58) Field of Classification Search
CPC ..... E05B 47/0619; E05B 47/0002; E05B 17/0054; E05B 47/0603; E05B 17/0062; E05B 2047/0063; E05B 15/1614; E05B 47/0038; E05B 47/0623
USPC ..... 70/1.5, 1.7, 276, 413, 417, 422, 277, 70/278.1–278.3, 278.7, 279.1, 280–283, 70/283.1
See application file for complete search history.

(56) References Cited

U.S. PATENT DOCUMENTS 4,074,548 A * 2/1978 Milton ..... E05B 17/0062 70/1.5
4,231,244 A * 11/1980 Krugener ..... E05B 17/0062 70/1.5
4,301,668 A * 11/1981 Renz ..... E05B 17/0062 70/422
4,939,915 A * 7/1990 Vonlanthen ..... E05B 47/063 70/277
6,125,673 A * 10/2000 Luker ..... E05B 47/0038 70/276
7,000,441 B2 * 2/2006 Sutton ..... E05B 47/0623 70/276

(Continued)

*Primary Examiner* — Lloyd A Gall
(74) *Attorney, Agent, or Firm* — The Belles Group, P.C.

(57) ABSTRACT

An electronic locking device including a cylinder and a plug located in the cylinder. Within the plug is a solenoid with a pair of shuttles which move in opposite directions. A control processor controls the solenoids activating the shuttles when connected to the correct key. Blocking elements for each shuttle are inserted through the cylinder and into annular channels in the plug. The blocking elements receive and allow linear movement of the shuttles but prevent their rotation within the annular channels. In a locked condition the shuttles are contained only partially within the annular channels thereby preventing rotation of the plug within the cylinder but in an unlocked condition the shuttles are contained within the annular channels thereby allowing rotation of the plug. The plug also includes a weakness defining a point at which it will break upon application of excessive force.

7 Claims, 7 Drawing Sheets

(56) References Cited

U.S. PATENT DOCUMENTS

| | | | | |
|---|---|---|---|---|
| 7,669,445 | B2 * | 3/2010 | Gartner | E05B 37/08 292/336.5 |
| 7,987,687 | B2 * | 8/2011 | Spycher | E05B 47/063 70/278.7 |
| 8,650,919 | B2 * | 2/2014 | Liu | E05B 17/2092 70/367 |
| 2001/0018837 | A1 * | 9/2001 | Imedio Ocana | E05B 47/0673 70/422 |
| 2014/0152420 | A1 * | 6/2014 | Wolski | G07C 9/00309 340/5.6 |
| 2015/0284975 | A1 * | 10/2015 | Karsil | E05B 45/06 70/344 |
| 2016/0281390 | A1 * | 9/2016 | Chow | E05B 47/0009 |

* cited by examiner

Figure 4.
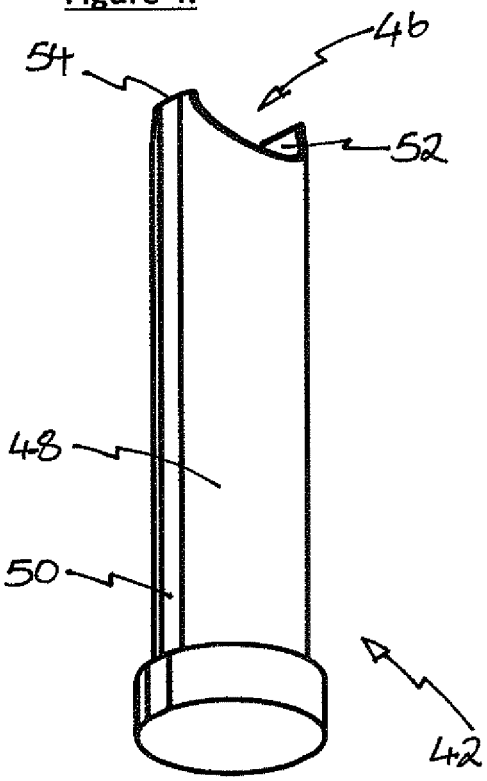
Figure 5.
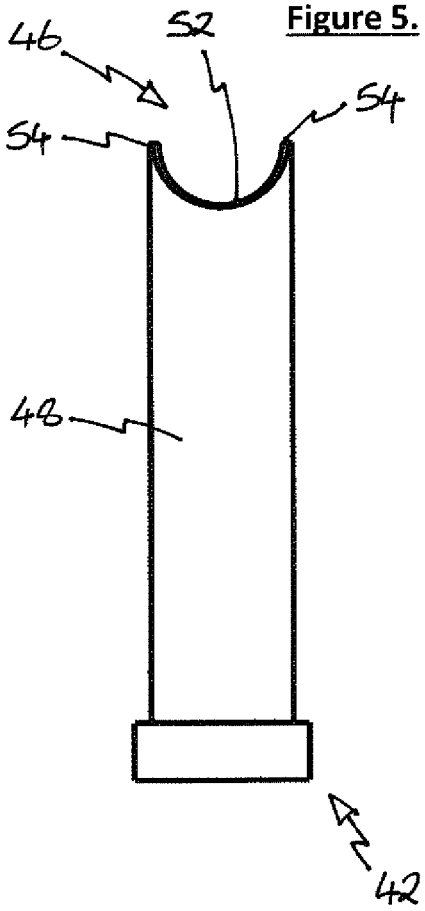
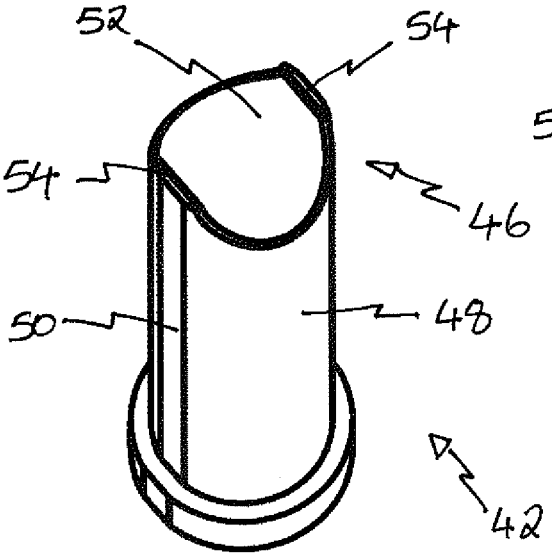
Figure 6.
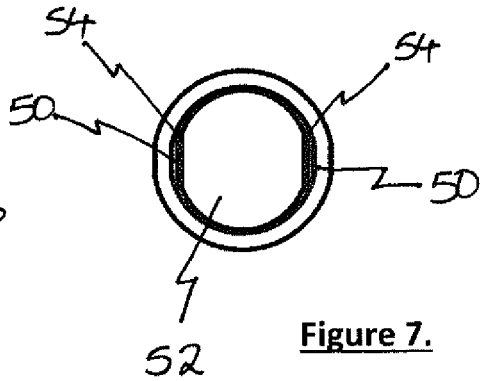
Figure 7.

ELECTRONIC LOCKING DEVICE

CROSS-REFERENCE TO RELATED APPLICATIONS

This application claims priority under 35 U.S.C. § 119 of GB Application No. 1706982.4, filed May 3, 2017. The disclosure of the above application is incorporated herein by reference.

FIELD OF INVENTION

The present invention relates to an electronic locking device and relates particularly, but not exclusively, to a locking device using solenoids and formed as a euro-cylinder.

BACKGROUND

The use of one or more solenoids to control the locked and unlocked conditions in an electronic locking device is well known. It is preferable when forming such locks to use a solenoid with a pair of shuttles which act in opposing directions. This ensures that the locking device cannot be overcome by simply applying a strong magnetic field to one side of the lock to move the shuttle since the pair of shuttles must move in opposite directions to unlock the device and the magnetic field will act on them both in the same direction causing at least one to remain in its locked condition. With such bidirectional shuttles, the space required to easily operate makes it desirable to align the solenoid coaxially within the plug and cylinder. An example of such an electronic locking device is disclosed in our earlier application published by the European Patent Office under the number EP1331328. The operation of the solenoid in this device requires the cylinder to be constructed from a pair of cast components which together form the cylinder. However, to produce such a cast component economically requires materials other than stainless steel or brass to be used. Zinc Alloy, commonly known as Mazak or Zamak, is an example of these castable materials. The use of these other materials is generally undesirable as they lack the strength, wear resistance and other important properties of materials for locks. For these reasons, they are unpopular with locksmiths.

Lock snapping is a known vulnerability of some euro cylinder locks and similar devices. It is therefore commonplace for an intruder, when confronted with a euro cylinder to attempt a lock snapping attack. Many locks are formed with additional security measures to attempt prevent lock snapping allowing access to the internal working of the lock. However, many of these are not suitable for use with electronic locks leaving them vulnerable to a snapping attack.

Preferred embodiments of the present invention seek to overcome or alleviate the above described disadvantages of the prior art.

BRIEF SUMMARY

According to an aspect of the present invention there is provided an electronic locking device comprising: a cylinder defining a cylindrical space; a plug received in said cylindrical space, said plug including at least one annular channel formed therein; at least one solenoid including at least one shuttle movable between a first and a second position; at least one control device for receiving a signal from a key and selectively activating said solenoid in response to a correct said signal; at least one blocking element inserted into said cylinder, said blocking element extending into said cylindrical space and into said annular channel, said blocking element receiving and allowing linear movement of said shuttle and preventing rotation of said shuttle within said annular channels, wherein in a locked condition said shuttle is contained only partially within said annular channels thereby preventing rotation of said plug within said cylinder and in an unlocked condition said shuttle is contained within said annular channels thereby allowing rotation of said plug within said cylinder.

By including the blocking elements described above the advantage is provided that a solenoid can be aligned coaxially with the axis of rotation of the plug without the need to form the cylinder from a castable material. As a result, standard lock making materials, such as stainless steel and brass, can be utilized in the production of this electronic lock. In particular, a pair of the blocking elements, which are straightforward in their shape to produce, can be utilized together with a pair of solenoids acting in opposite directions or a single solenoid which activates shuttles in opposing directions.

The locking device may further comprise at least one cam rotatable with said plug.

The locking device may also further comprise a plurality of blocking elements and said solenoid comprises a plurality of shuttles.

Using a solenoid with a plurality of shuttles, in particular where the activated solenoid moves the shuttles in opposite directions, the advantage is provided that the application of a strong magnet on one side of the lock will only act to move one of the shuttles into an unlocked condition whilst leaving the other in the locked condition and thereby maintaining the door likewise in such a locked condition.

In a preferred embodiment the cylinder comprises a euro-cylinder.

In another preferred embodiment the plug comprises at least one weakness defining a point at which said plug will break upon application of excessive force and wherein said cam is located partially along the length of said cylinder thereby dividing said cylinder into a first portion and a second portion, wherein said solenoid is located in one of said first and second portions and said weakness is located in the other of said first and second portions.

According to another aspect of the present invention there is provided an electronic locking device comprising: a cylinder; a plug received in said cylinder, said plug including at least one weakness defining a point at which said plug will break upon application of excessive force; at least one solenoid including at least one shuttle movable between a first and a second position thereby switching the locking device between a locked and an unlocked condition; at least one control device for receiving a signal from a key and selectively activating said solenoid in response to a correct said signal; at least one cam rotatable with said plug when the locking device is in said unlocked condition, said cam is located partially along the length of said cylinder thereby dividing said cylinder into a first portion and a second portion, wherein said solenoid is located in one of said first and second portions and said weakness is located in the other of said first and second portions.

By forming an electronic locking device with a weakness and locating the weakness on one side of a cam whilst locating the locking mechanism including the solenoid on the other side of the cam, provides security advantages. In particular, the device can be arranged so that the weakness is on the outer side of the door and the locking mechanism on the secured/friendly/inside of the door. As a result, any attempt to overcome the lock by snapping the plug will still leave the device in a locked condition even if access is obtained all the way through the plug to the cam as the cam is secured to the inside plug.

In a preferred embodiment the cylinder comprises a euro-cylinder.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Preferred embodiments of the present invention will now be described, by way of example only, and not in any limitative sense with reference to the accompanying drawings in which:

FIGS. 4 to 7 are perspective from below, side, top and perspective from above views of a blocking element which is a component of the locking device of FIG. 1;

DETAILED DESCRIPTION

The following description of the preferred embodiment(s) is merely exemplary in nature and is in no way intended to limit the invention, its application, or uses.

Figure 1:
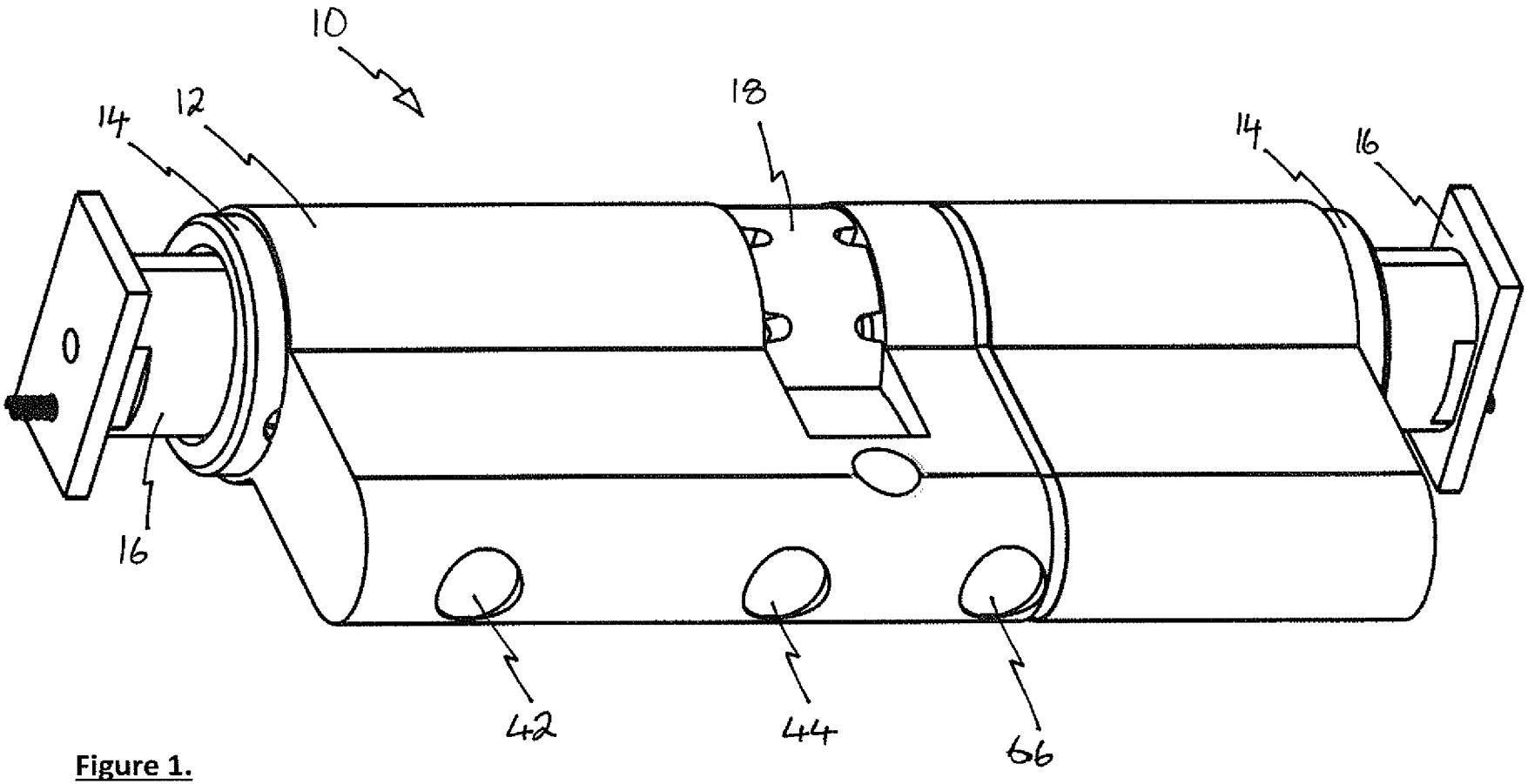
FIG. 1 is a perspective view of a locking device of the present invention.

Referring initially to FIG. 1, an electronic locking device 10 includes a cylinder 12 and a plug 14 and in the embodiment shown in FIG. 1 these are in the form commonly referred to as a euro cylinder. The locking device 10 is operated using keys, a portion of which are indicated at 16 in FIGS. 1, 2, 9 and 10 and shown more completely in FIG. 3. The keys include a power supply, a signal generator and one or more connectors for transferring the power and signal to the locking device 10. When in an unlocked condition, the locking device 10 rotates a cam 18 which acts on a further element or elements of a door, window or the like (and which are not shown) in a manner familiar to person skilled in the art.

Figure 2:
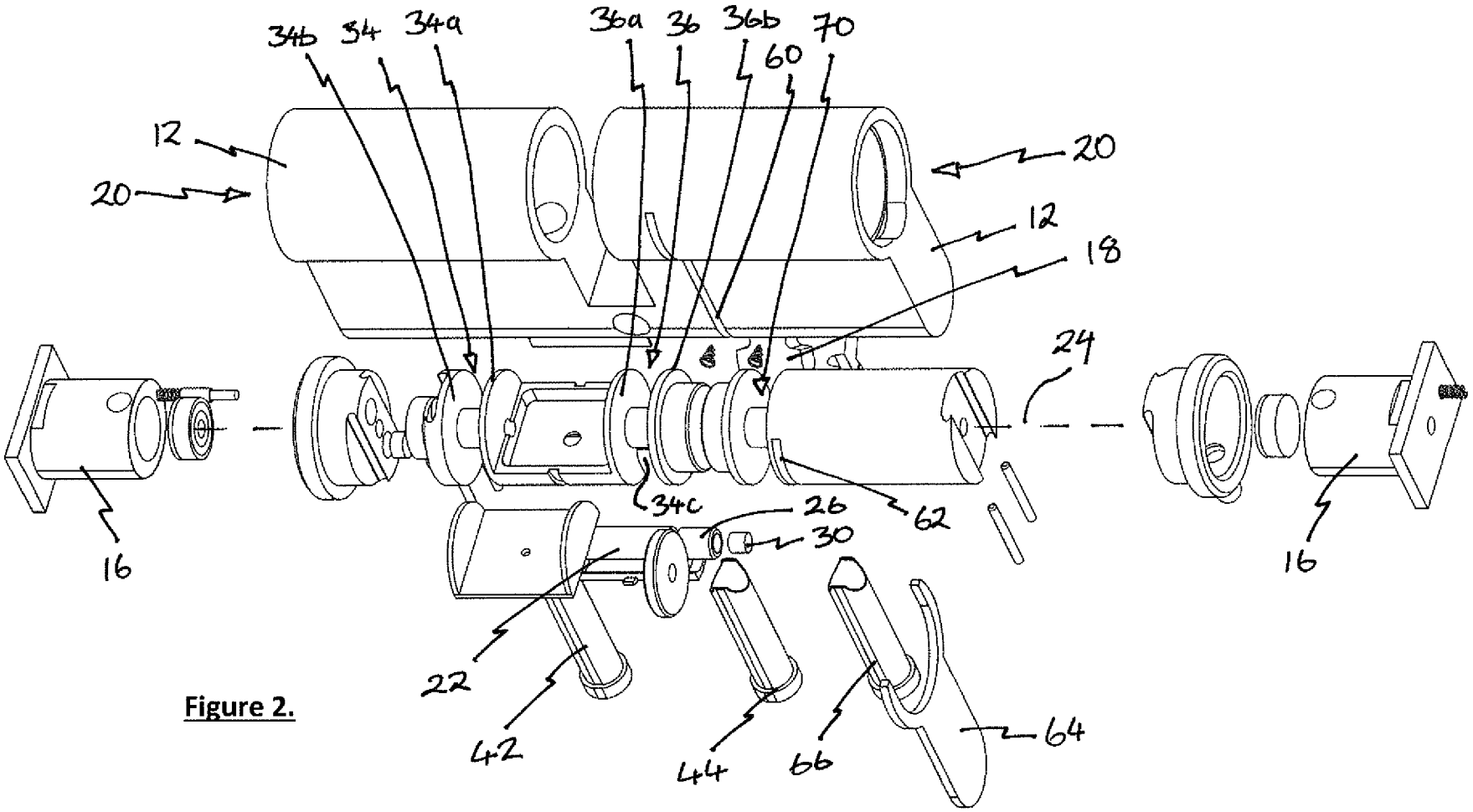
FIG. 2 is an exploded perspective view of the locking device of FIG. 1.
Figure 3:
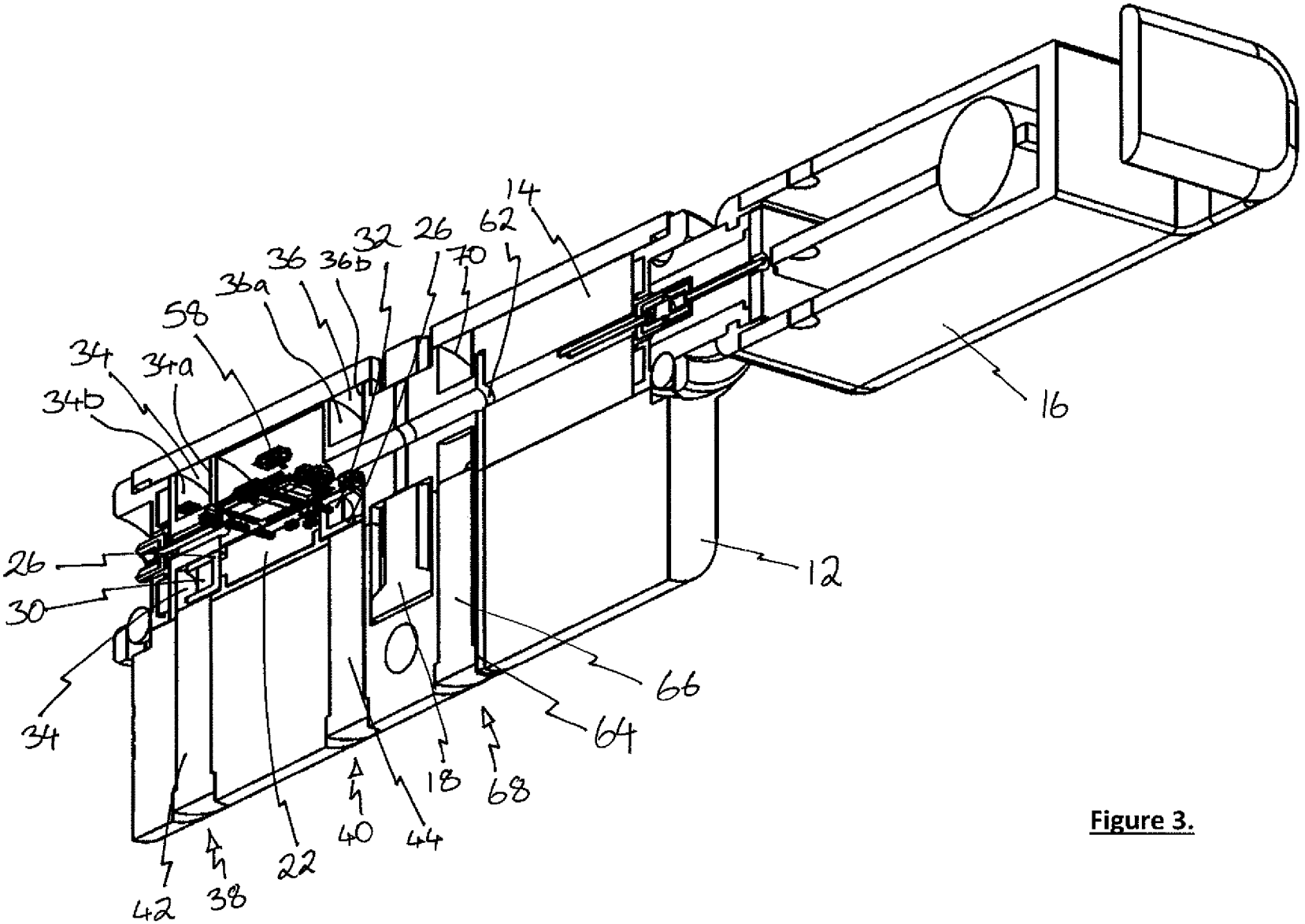
FIG. 3 is a sectional perspective view along the axis of the locking device showing the device of FIG. 1.
Figure 8:
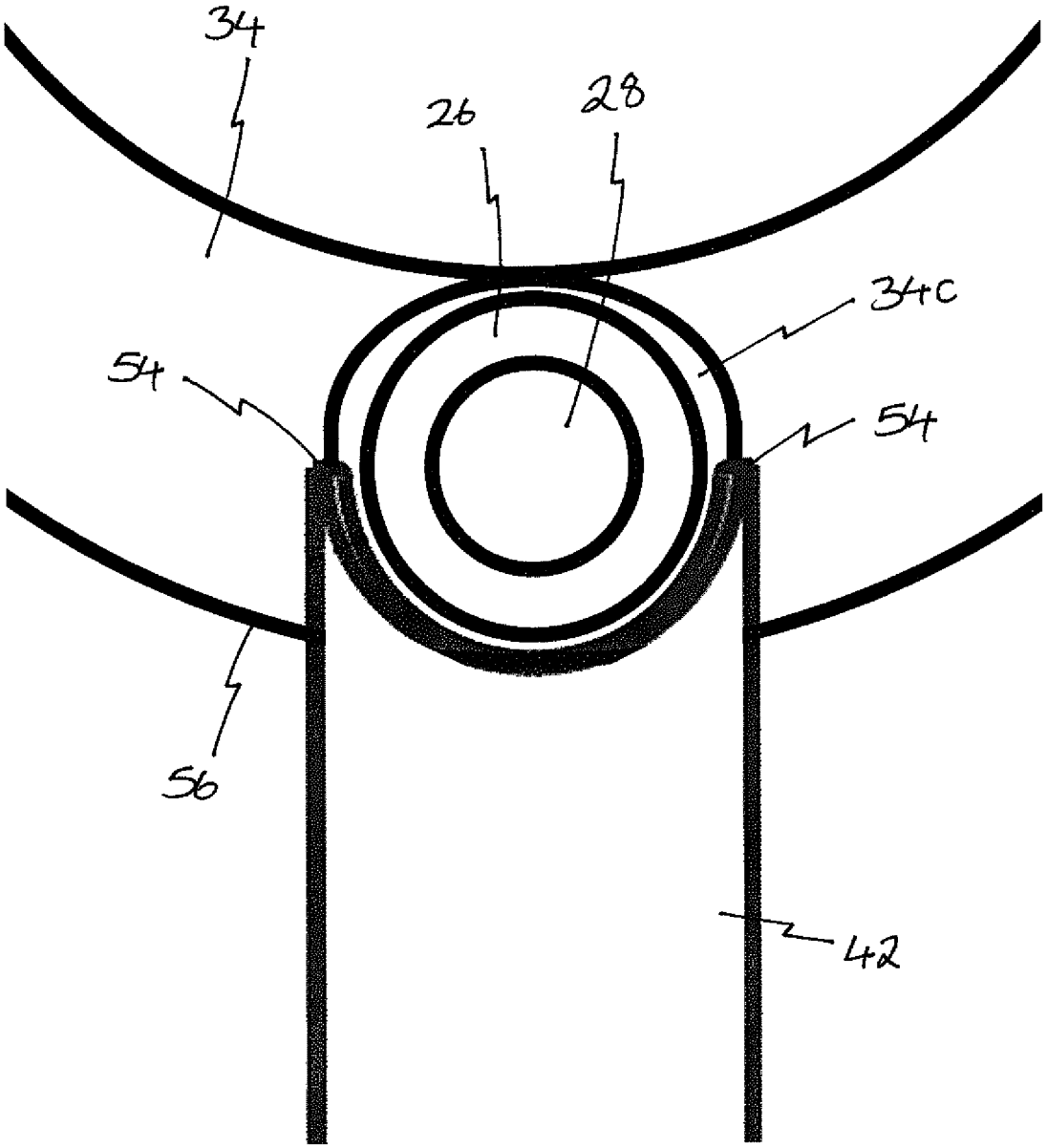
FIG. 8 is a schematic sectional view perpendicular to the axis of the locking device (section taken along the line A-A in FIG. 10) including the component shown in FIGS. 4 to 7.

With additional reference to FIGS. 2 and 3, the cylinder 12 defines a cylindrical space 20 into which the plug 14 is located. Because the cylinder 12 is in the euro cylinder form the cam 18 divides the cylindrical space 20 into a pair of such spaces on either side of the cam. The plug 14 is substantially cylindrical in its shape, that is its radially outermost dimensions fit within the cylindrical space 20 and when the plug 14 is formed with its associated components the plug assembly can be inserted into the cylindrical space 20 from one end.

The device 10 further includes a solenoid 22 which is positioned coaxially with an axis of rotation 24 of the plug 14. The solenoid 22 as a pair of shuttles 26 and 28 which contain magnets 30 and 32. The shuttles and their associated magnets operate at either end of the solenoid 22 in opposite directions to each other. In other words, when power is supplied to the electromagnet within solenoid 22 the magnets 30 and 32 of shuttles 26 and 28 are repelled in opposite directions.

Formed as part of the plug are a pair of annular channels 34 and 36 which extend at least partially around the axis 24 of plug 14. The annular channels 34 and 36 are sized to receive and contain the shuttles 26 and 28 respectively. As a result, when the shuttles 26 and 28 are within the annular channels 34 and 36 the plug 14 can rotate around axis 24 without the shuttles 26 and 28 rotating. The channels 34 and 36 are defined by circular walls 34*a* and 34*b* and by 36*a* and 36*b* respectively, with walls 34*a* and 36*a* being those immediately adjacent the solenoid 22 therefore being the innermost walls with respect to the solenoid. In both of those innermost walls 34*a* and 36*a* a notch is formed which is sized to allow the shuttles 26 and 28 to pass therethrough. These notches are hereinafter referred to using the reference numerals 34*c* and 36*c* although in the figures only notch 34*c* can be seen in FIG. 2.

Formed into the cylinder 12 are a pair of apertures 38 and 40 into which extend a pair of blocking elements 42 and 44. The blocking elements 42 and 44 are shown in more detail in FIGS. 4 to 7 and are substantially cylindrical in their form. The purpose of the blocking elements 42 and 44 is to receive the shuttles 26 and 28 by allowing the linear movement of the shuttles in response to power being supplied to the solenoid 22. However, the shape of the upper ends of the blocking elements 42 and 44 prevent the shuttles 26 and 28 rotating within the annular channels 34 and 36 when the plug 14 rotates within the cylinder 12. Detail of this upper end is shown in FIGS. 4 to 8 and indicated with reference numeral 46. In particular, the upper end 46 is shaped as though formed with an aperture extending perpendicular to the main cylindrical body 48 having a radius similar to the radius of the curve which forms the body 48. The body 48 is not perfectly cylindrical and has flat portions 50 which prevent the rotation of the blocking elements 42 and 44 within the apertures 38 and 40 which are shaped to match and receive the blocking elements. The upper end 46 of the blocking element 42 has a curved top surface 52 which end in tips 54 at the very top of the blocking element. When correctly located in the cylinder the bottommost portion of the curved surface 52 is approximately aligned with the radially outermost edge 56 of the annular channel 34. This outermost edge of the annular channel coincides with the outer surface of the cylindrical space 20. Because the bottom of curved surface 52 is aligned with the outermost edge 56 of the annular channel 34 the tips 54 of blocking element 42 extend into the annular space 34.

The locking device 10 further includes a control device in the form of a processor which is located in the space indicated at 58 in the figures. The processor 58 receives a signal from either of the keys 16 and determines whether to activate the solenoid 22.

The cylinder 12 and plug 14 are provided with weakness portions respectively indicated at 60 and 62. In the embodiment shown in the figures these weaknesses are in the form of slits cut into the cylinder 12 and plug 14. The purpose of these weakness portions is to ensure that if a strong mechanical force is applied to the outside of the locking device 10 (that is the left-hand end in FIGS. 2, 9 and 10 and the right-hand end in FIGS. 1 and 3) that the cylinder and/or plug break at this point. In the locking device 10 the cam 18 is fixed to the plug 14 so that rotation of the plug also rotates the cam. The cam 18 can be regarded as dividing the cylinder 12 into two portions with the weakness portions being located in one portion and the locking mechanism, that is the solenoid, blocking elements and the annular channels, being in the other portion. As a result, simply breaking the cylinder and/or plug will not allow the device to be unlocked as the shuttles 26 and 28 of the solenoid 22 will remain an activated and therefore in the locked condition.

A protection plate 64 is located in slit 60. The protection plate 64 is formed from a material, such as hardened steel, which is harder, or more resistant to an attack by a tool such as a drill, than the material of the cylinder 12 (which is typically brass or stainless steel). The protection plate 64 is held in place by an additional blocking element 66 which is associated with a respective aperture 68 (similar to apertures 38 and 40) and a respective annular channel 70 (similar to channels 34 and 36). Alternative components could be used to fix the protection plate in place.

Figure 9:
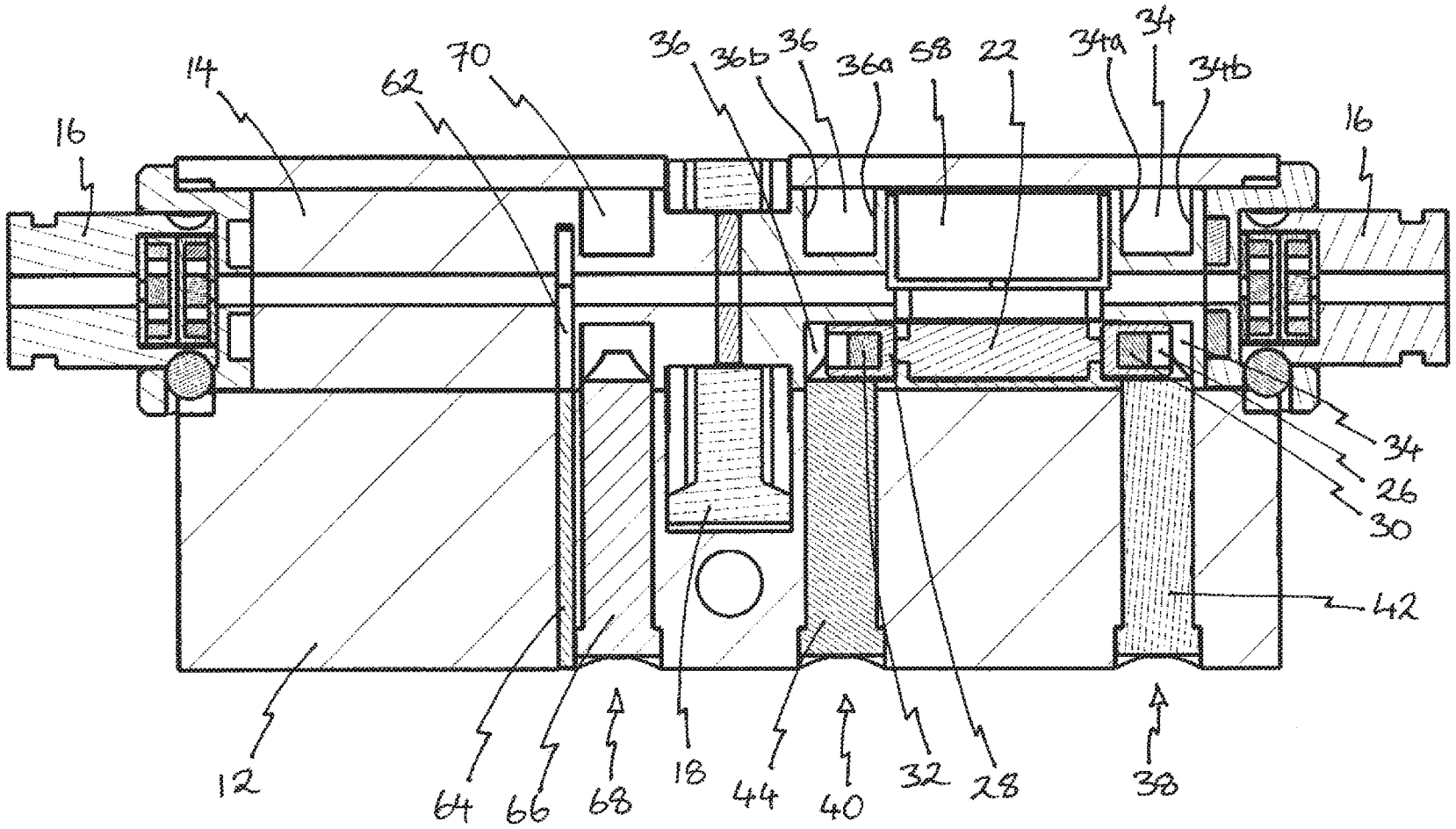
FIGS. 9 and 10 are sectional views along the axis of the locking device showing the device of FIG. 1 in locked and unlocked conditions respectively.
Figure 10:
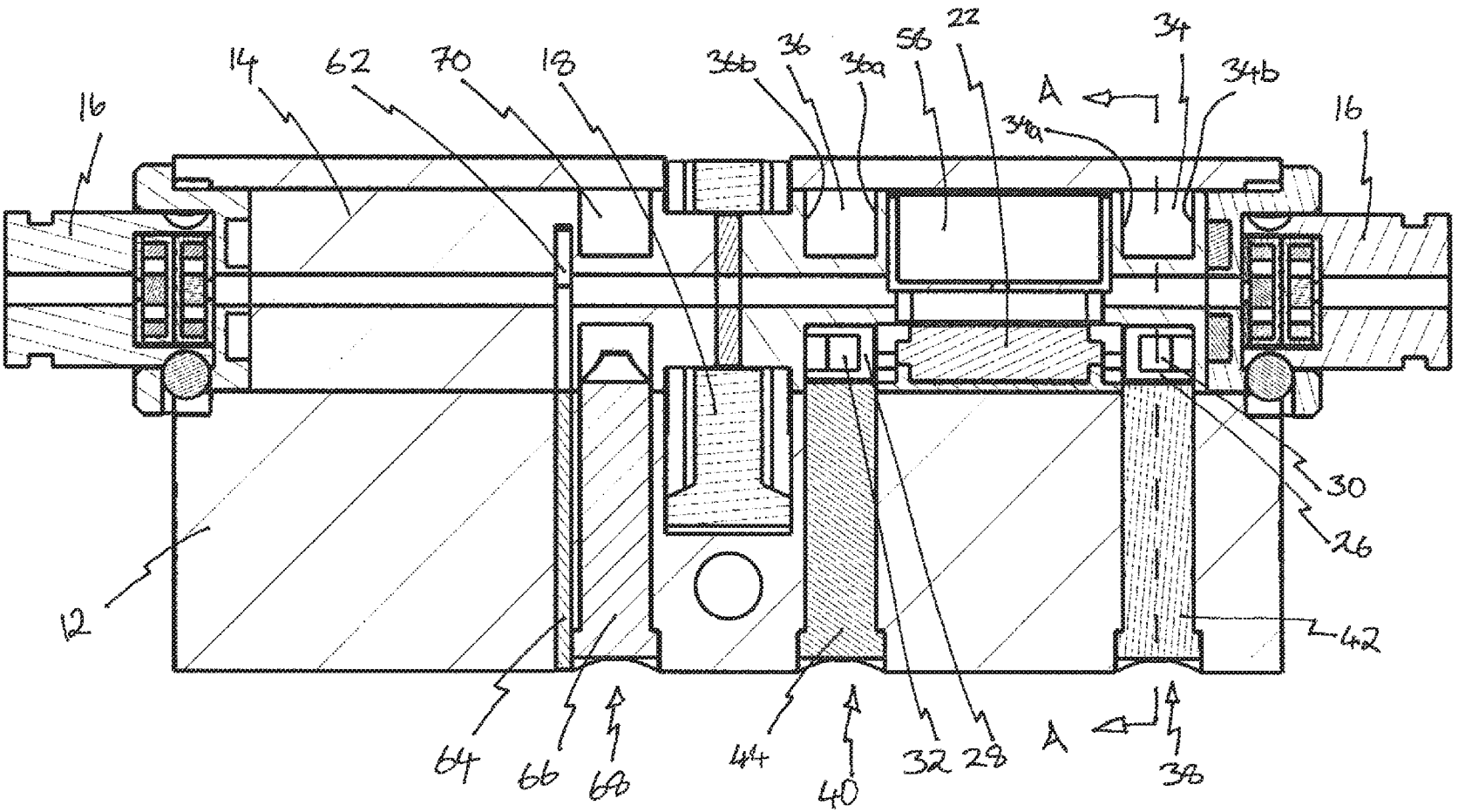

Operation of the locking device 10 will now be described with particular reference to FIGS. 9 and 10. FIG. 9 shows the locking device 10 engaged with key portions 16. In the normal operation of the locking device 10 only a single key is required to unlock the device. In FIG. 9 the solenoid 22 is not activated and the magnets 30 and 32 of the shuttles 26 and 28 are attracted to the iron core which forms part of the solenoid 22 and, as a result, the shuttles 26 and 28 but the ends of the solenoid 22. The locking device 10 is therefore in a locked condition meaning that the plug 14 is unable to rotate within the cylinder 12 thereby also preventing movement of the cam 18. This prevention of rotation of the plug 14 within the cylinder 12 results from the shuttles 26 and 28 extending only partially into the annular channels 34 and 36. This in turn means that the shuttles 26 and 28 extend into the notches 34*c* and 36*c* in the walls 34*a* and 36*a*. As a result, when a turning force is applied to the plug 14 the edge of notches 34*c* and 36*c* engage and press against their respective shuttles 26 and 28. Rotational movement of the shuttles is in turn prevented by the shuttles pressing against the curved surface 52 of the blocking elements 42 and 44.

The power supply for the locking device is contained within the key 16 and when the key engages the end portion of the plug 14 power and a signal is sent to the processor 58 along wires which are not shown. The power results in activation of the processor which compares the signal to determine whether it is the correct signal for that lock. If the signal is correct the processor further uses the power to activate the solenoid 22 which creates a magnetic field. The magnets 30 and 32 in shuttles 26 and 28 are aligned so as to be repelled by this magnetic field therefore moving away from the solenoid 22 and into the annular channels 34 and 36. The shuttles 26 and 28 therefore no longer extend into the notches 34*c* and 36*c* and the plug 14 is no longer prevented from rotating within the cylinder 12. Because the curved surface 52 is shaped to fit shuttles 26 and 28, the shuttles cannot rotate with the plug 14 as it turns. The power from the key 16 only activates the solenoid 22 for a short period of time, typically 2 seconds, which is sufficient time for the operator to apply a turning force to the plug 14 whilst the solenoid is pushing the shuttles 26 and 28 into the annular channels 34 and 36 (as shown in FIG. 10). After this period of time, when the solenoid is no longer receiving power the magnets 30 and 32 in shuttles 26 and 28 are no longer repelled from the solenoid 22 and are indeed attracted to the ferrous core of the solenoid. However, the innermost walls 34*a* and 36*a* prevent the shuttles re-engaging with the solenoid until the plug is rotated back to its starting position and the notches 34*c* and 36*c* are aligned with the shuttles. Once these components are realigned the shuttles 26 and 28 will pass back into the notches 34*c* and 36*c* thereby returning the locking device 10 to its locked condition.

It will be appreciated by persons skilled in the art that the above embodiments have been described by way of example only and not in any limitative sense, and that various alterations and modifications are possible without departure from the scope of the protection which is defined by the appended claims. For example, in the embodiment described above the annular channels 34 and 36 extend around the whole of the circumference of the plug 14. However, the channels need only extend as far as the rotation of the plug in normal operation of the locking device requires. The channel extending around the whole of the circumference of the plug allows the plug to rotate through 360° or more and is easier to manufacture than a partial annular channel.

What is claimed is:

1. An electronic locking device comprising:

a cylinder defining a cylindrical space;

a plug received in said cylindrical space, said plug including at least one annular channel formed therein;

at least one solenoid including at least one shuttle movable between a first and a second position;

at least one control device for receiving a signal from a key and selectively activating said at least one solenoid in response to a correct said signal;

at least one blocking element inserted into said cylinder, said at least one blocking element extending into said cylindrical space and into said at least one annular channel, said at least one blocking element receiving and allowing linear movement of said at least one shuttle and preventing rotation of said at least one shuttle within said at least one annular channel, wherein in a locked condition said at least one shuttle is contained only partially within said at least one annular channel thereby preventing rotation of said plug within said cylinder and in an unlocked condition said at least one shuttle is contained within said at least one annular channel thereby allowing rotation of said plug within said cylinder.

2. An electronic locking device according to claim 1, further comprising at least one cam rotatable with said plug.

3. An electronic locking device according to claim 1, further comprising a plurality of blocking elements and said at least one solenoid comprises a plurality of shuttles.

4. An electronic locking device according to claim 1, wherein said cylinder comprises a euro-cylinder.

5. An electronic locking device according to claim 1, wherein said plug comprises at least one weakness defining a point at which said plug will break upon application of excessive force and wherein a cam is located partially along the length of said cylinder thereby dividing said cylinder into a first portion and a second portion, wherein said at least one solenoid is located in one of said first and second portions and said at least one weakness is located in the other of said first and second portions.

6. An electronic locking device comprising a cylinder;

a plug received in said cylinder, said plug including at least one weakness defining a point at which said plug will break upon application of excessive force;

at least one solenoid including at least one shuttle movable between a first and a second position thereby switching the locking device between a locked and an unlocked condition;

at least one control device for receiving a signal from a key and selectively activating said at least one solenoid in response to a correct said signal;

at least one cam rotatable with said plug when the locking device is in said unlocked condition, said at least one cam is located partially along the length of said cylinder thereby dividing said cylinder into a first portion and a second portion, wherein said at least one solenoid is located in one of said first and second portions and said at least one weakness is located in the other of said first and second portions.

7. An electronic locking device according to claim 6, wherein said cylinder comprises a euro-cylinder.

* * * * *